US010982389B2

(12) United States Patent
Postl et al.

(10) Patent No.: US 10,982,389 B2
(45) Date of Patent: Apr. 20, 2021

(54) PIN SEAMED PRESS FELT AND METHOD OF MAKING SAME

(71) Applicant: Huyck Licensco Inc., Youngsville, NC (US)

(72) Inventors: Friedrich Postl, Flatz (AT); Klaus Haiden, Neunkirchen (AT)

(73) Assignee: Huyck Licensco Inc., Youngsville, NC (US)

( * ) Notice: Subject to any disclaimer, the term of this patent is extended or adjusted under 35 U.S.C. 154(b) by 189 days.

(21) Appl. No.: 15/992,753

(22) Filed: May 30, 2018

(65) Prior Publication Data

US 2018/0347113 A1 Dec. 6, 2018

Related U.S. Application Data

(60) Provisional application No. 62/512,874, filed on May 31, 2017.

(51) Int. Cl.
*D21F 7/10* (2006.01)
*D21F 7/08* (2006.01)

(52) U.S. Cl.
CPC ..... *D21F 7/10* (2013.01); *D21F 7/083* (2013.01)

(58) Field of Classification Search
CPC . D21F 7/08; D21F 7/083; D21F 7/086; D21F 7/10; D21F 7/12; D21F 1/10; D21F 1/12; D21F 1/0027; D21F 1/0054
(Continued)

(56) References Cited

U.S. PATENT DOCUMENTS 4,026,331 A * 5/1977 Lees ..... D21F 1/0054 139/383 A
4,095,622 A 6/1978 MacBean
(Continued)

FOREIGN PATENT DOCUMENTS

JP H01102198 U 7/1989
WO 00/17433 A1 3/2000
WO 2017/023995 A1 2/2017

OTHER PUBLICATIONS

Notification Concerning Transmittal of International Preliminary Report on Patentability corresponding to International Application No. PCT/US2016/045282 dated Feb. 15, 2018.
(Continued)

*Primary Examiner* — Eric Hug
(74) *Attorney, Agent, or Firm* — Myers Bigel, P.A.

(57) ABSTRACT

A method of making a fabric for a press felt for a paper-making machine includes:

(a) forming a base fabric comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, comprising a plurality of repeat units, each of the repeat units comprising a plurality of cabled cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle; and
(Continued)

(b) removing the second pintle from the ends of the second set of MD yarns; and (c) tensioning the fabric so that each of the ends of the second set of MD yarns forms a gap with a respective end of first set of MD yarns that approaches the seam from the opposite direction, and wherein the gap is no more than about 0.3 mm.

18 Claims, 3 Drawing Sheets

(58) Field of Classification Search
USPC ..... 162/348, 358.1, 358.2, 900, 902–904; 139/383 A, 383 AA, 425 A
See application file for complete search history.

(56) References Cited

U.S. PATENT DOCUMENTS 4,186,780 A * 2/1980 Josef ..... D03D 3/04 139/383 AA
4,438,789 A 3/1984 MacBean
4,601,785 A 7/1986 Lilja et al.
4,737,241 A 4/1988 Gulya
4,764,417 A 8/1988 Gulya
4,824,525 A * 4/1989 Penven ..... D21F 1/0036 139/383 AA
4,892,781 A 1/1990 Penven
5,411,062 A 5/1995 Lee
5,476,123 A 12/1995 Rydin
5,618,612 A 4/1997 Gstrein
5,799,708 A 9/1998 Josef
6,079,454 A 6/2000 Lee et al.
6,213,164 B1 4/2001 Ostermayer et al.
6,302,155 B1 10/2001 Rydin
6,431,221 B1 * 8/2002 Wrigley ..... D21F 1/0054 139/383 AA
6,776,878 B2 * 8/2004 Yook ..... D21F 1/0027 162/358.2
7,135,093 B2 11/2006 Gstrein
8,317,979 B2 11/2012 Bast et al.
2004/0182467 A1 9/2004 Gstrein
2012/0135184 A1 5/2012 Lang
2014/0190645 A1 7/2014 Breuer et al.
2015/0211179 A1 7/2015 Alias et al.
2016/0069022 A1 3/2016 Lee
2017/0037573 A1 * 2/2017 Postl ..... D21F 7/08

OTHER PUBLICATIONS

Notification of Transmittal of the International Search Report and the Written Opinion of the International Searching Authority, or the Declaration corresponding to International Application No. PCT/US2016/045282 dated Oct. 21, 2016.
Notification of Transmittal of the International Search Report and the Written Opinion of the International Searching Authority, or the Declaration corresponding to International Application No. PCT/US2018/034996 dated Sep. 20, 2018.
International Preliminary Report on Patentability corresponding to International Application No. PCT/US2018/034996 dated Dec. 12, 2019.
Examination Report corresponding to Australian Application No. 2018277741 dated Aug. 20, 2020.
"Office Action corresponding to Canadian Application No. 3,058,201 dated Dec. 2, 2020".
"Office Action corresponding to Chinese Application No. 2018800349470 dated Sep. 27, 2020".
"Office Action corresponding to Japanese Application No. 2020-515838 dated Nov. 13, 2020".
"Extended European Search Report corresponding to European Application No. 18809754.7 dated Feb. 10, 2021".

* cited by examiner

PIN SEAMED PRESS FELT AND METHOD OF MAKING SAME

RELATED APPLICATION

The present application claims priority from and the benefit of U.S. Provisional Patent Application No. 62/512,874, filed May 31, 2017, the disclosure of which is hereby incorporated herein in full.

FIELD OF THE INVENTION

The present invention relates generally to papermaking, and more particularly to fabrics used in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a dryer section for further moisture removal. After drying, the paper is ready for secondary processing and packaging.

Press felts typically include one or more base fabric layers; these can be "flat-woven" and formed after weaving into an endless belt, or can be woven in endless form.

Of course, weaving a fabric of a base layer requires that provision be made for joining it into an endless belt. Such joints should be constructed in such a manner that they are sufficiently strong to withstand the extreme load, temperature, and wear conditions the press felt experiences, yet do not cause the surface of the press felt above the seam to unduly mark the paper. One popular method of joining the base fabric of a press felt is to form loops with machine direction yarns on each end of the base fabric; these loops are often formed over a pin or "pintle" during the weaving process. To form the base fabric into an endless belt, the ends of the fabric are placed adjacent to each other, with each of the loops on one end positioned between two loops on the other end in interdigitating fashion. A "pin" (usually formed of a single monofilament or multiple monofilament strands) is then inserted into all of the loops to join the ends. After the batt layer(s) are needled or otherwise attached to the base layer, the batt layer(s) are cut at the seam location, the pin is removed, and the finished press felt is shipped to a paper mill. Once at the paper mill, the press felt can be installed by placing it onto a paper machine, then inserting another (usually more flexible) monofilament pin or pintle into the loops. Examples of this type of seam are described in U.S. Pat. Nos. 4,764,417 and 4,737,241 to Gulya; U.S. Pat. No. 4,601,785 to Lilja et al.; U.S. Pat. No. 5,476,123 to Rydin, and U.S. Pat. No. 7,135,093 to Gstrein, the disclosures of which are hereby incorporated herein by reference in their entireties.

Base fabrics of press felts have taken a variety of configurations. In one configuration, the "fabric" is actually two separate fabrics that form a total of three layers. The bottom fabric is a double layer fabric that provides the seam loops, with the top fabric being a single layer fabric that is cut after weaving, combination with the bottom fabric, and needling of an overlying batt layer. An exemplary press felt of this configuration is shown in International Patent Application No. WO 0017433, the disclosure of which is hereby incorporated herein in its entirety. One apparent disadvantage of a fabric of this configuration is the need to cut the top fabric layer, which then has loose ends that can impact the manner in which the overlying batt lays over the fabric. A single layer fabric does not have this disadvantage.

SUMMARY

As a first aspect, embodiments of the invention are directed to a press felt for a papermaking machine, comprising: (a) a base fabric comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends and the second set of MD yarns are devoid of seam loops at their ends; and (b) at least one batt layer overlying the base fabric. Each of the ends of the second set of MD yarns forms a gap with a respective end of first set of MD yarns that approaches the seam from the opposite direction, and wherein the gap is no more than about 0.3 mm.

As a second aspect, embodiments of the invention are directed to a fabric for a press felt, comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle.

As a third aspect, embodiments of the invention are directed to a method of making a fabric for a press felt for a papermaking machine, comprising:

(a) forming a base fabric comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, comprising a plurality of repeat units, each of the repeat units comprising a plurality of cabled cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle; and (b) removing the second pintle from the ends of the second set of MD yarns; and (c) tensioning the fabric so that each of the ends of the second set of MD yarns forms a gap with a respective end of first set of MD yarns that approaches the seam from the opposite direction, and wherein the gap is no more than about 0.3 mm.

As a fourth aspect, embodiments of the invention are directed to a method of making a fabric for a press felt for a papermaking machine, comprising:

(a) forming a base fabric comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, comprising a plurality of repeat units, each of the repeat units comprising a plurality of cabled cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle; and (b) removing the second pintle from the ends of the second set of MD yarns; and (c) tensioning the fabric so that each of the ends of the second set of MD yarns slightly overlies a respective end of first set of MD yarns that approaches the seam from the opposite direction.

DETAILED DESCRIPTION OF EMBODIMENTS OF THE PRESENT INVENTION

Figure 1:
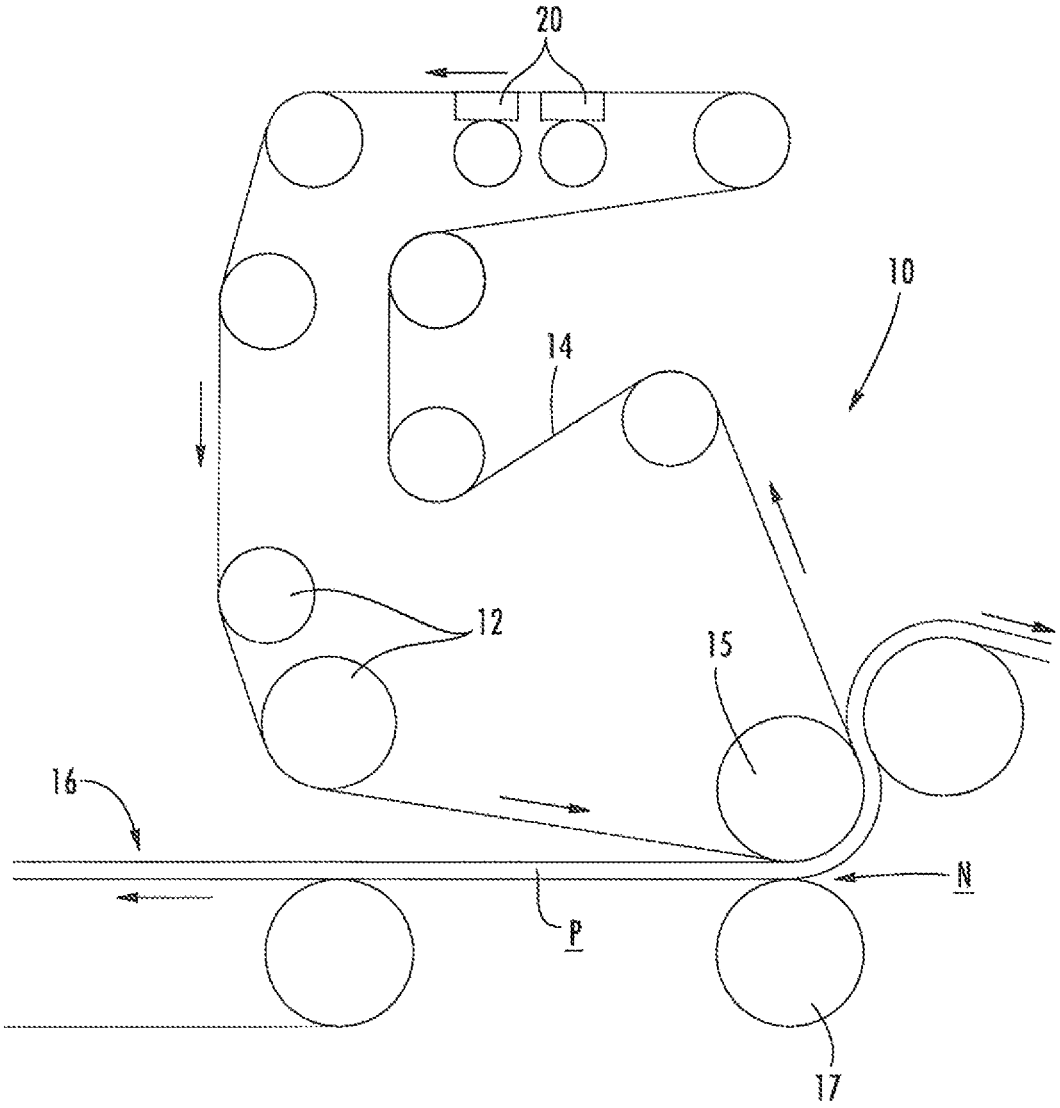
FIG. 1 is a schematic diagram illustrating the press section of a papermaking machine that may employ a press felt according to embodiments of the present invention.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein, the terms "machine direction" (MD) and "cross machine direction" (CMD) refer, respectively, to a direction aligned with the direction of travel of the papermakers' fabric on a papermaking machine, and a direction parallel to the fabric surface and transverse to the direction of travel. Also, both the flat weaving and endless weaving methods described hereinabove are well known in the art, and the term "endless belt" as used herein refers to belts made by either method.

Referring now to the drawings, a papermaking machine press section, designated broadly at 10, is illustrated in FIG. 1. The press section 10 includes a press felt 100 that is installed upon and conveyed by a set of rollers 12. In its travel, the felt 100 passes over a press roll 15. An opposed press roll 17 is positioned so that, in conjunction with the felt 100 and press roll 15, it forms a nip N between the press rolls 15, 17.

In operation, a paper web P is conveyed from a forming section 16 through the nip N formed by the press rollers 15, 17, wherein pressure is applied to the paper web P by the press rolls 15, 17. The pressure forces moisture from the paper web P that is absorbed by the felt 100. As the felt 100 is conveyed around its roller set 12, moisture is removed therefrom, and the felt 100 is conditioned by one or more suction boxes 20.

Figure 2:
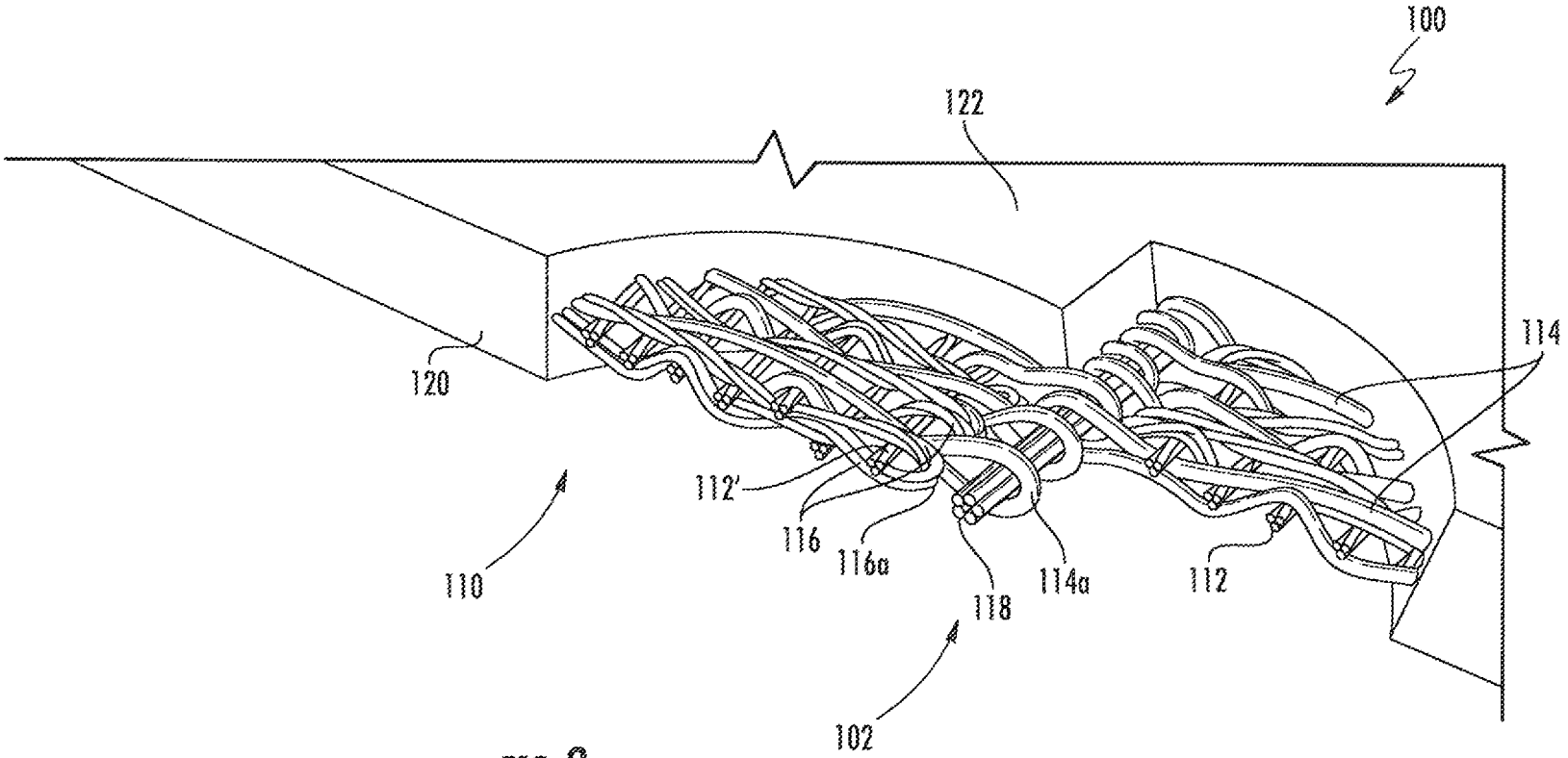
FIG. 2 is an enlarged, partial, cutaway side perspective view of a prior press felt usable with the press section of FIG. 1 showing the pin seam of the base fabric of the press felt.

FIG. 2 shows the seam area of a base fabric 110 of a prior felt 100, with a portion of the seam 102 of the felt 100 being shown therein. The fabric 110 includes cabled CMD yarns 112 interweaving with two different varieties of MD yarns. More specifically, MD yarns 114 are monofilament yarns, and MD yarns 116 are cabled yarns. The monofilament MD yarns 114 alternate with the cabled MD yarns 116 in a 1:1 pattern as the MD yarns 114, 116 interweave with the CMD yarns 112. The weaving pattern of the MD yarns 114, 116 and the CMD yarns 112 can be any weave pattern known to those of skill in this art to be appropriate for a base fabric of a press felt and need not be described in detail herein.

As can be seen in FIG. 2, the monofilament MD yarns 114 are interwoven with the CMD yarns 112 such that seam loops **114*a* are formed as each MD yarn 114 "doubles back" on itself to weave with the CMD yarns 112. The seam loops 114*a* capture a pintle 118 or other seaming member within the seam 102. As can be seen in FIG. 2, the seam loops 114*a* formed in one end of the fabric 110 interdigitate with the seam loops 114*a* from the other end of the fabric 110 to create space into which the pintle 118 can be inserted to form the seam 102**.

As can also be seen in FIG. 2, as the cabled MD yarns 116 interweave with the CMD yarns 112, they do not form seam loops when they "double back" to weave with the CMD yarns 112. Instead, when the cabled yarns 116 "double back", they do so by forming a loop around the CMD yarn 112 nearest the seam 102. Thus, the ends 116*a* of the cabled MD yarns 116 are routed short of the seam 102 and are devoid of seam loops. It can be seen that each end 116*a* is aligned across the seam 102 with a seam loop 114*a* of a monofilament MD yarn 114 that is routed to the seam 102 from the opposite side of the seam 102.

Referring still to FIG. 2, the press felt 100 includes two batt layers: a machine side batt layer 120 and a paper side batt layer 122. Illustratively, these batt layers 120, 122 are attached to the base fabric layer 110 through a needling process, although other attachment techniques, such as heat bonding and adhesives, can also be used with the present invention. The machine side and paper side batt layers 120, 122 should be formed of material, such as a synthetic fiber like acrylic, aramid, polyester, or nylon, or a natural fiber such as wool, that assists in wicking water away from the base fabric layer 110. Exemplary materials for the batt layers 120, 122 include polyamide, polyester and blends thereof. The weight and thickness of the batt layers 120, 122 can vary, although it is typical that the ratio of batt weight to fabric weight is between about 0.5 and 2.0, with 1.0 being more common. Also, in some embodiments, it may be desirable to have additional batt layers or to omit either or both of the batt layers 120, 122.

The fabric 110, which is described in detail in U.S. Patent Publication No. 2017/0037573, filed Aug. 4, 2016, the disclosure of which is hereby incorporated herein in its entirety, can provide performance advantages to the felt 100. The use of the monofilament MD yarns 114 can provide a smooth, stable seam, while the inclusion of the cabled MI) yarns 116 can improve anchoring of the batt fiber. In the past, typically press felts with cabled MD yarns lacked seam loops, as the cabled structure of the yarns was not conducive to forming seam loops that were easily interdigitated and/or filled with a pintle. The use of MD monofilament yarns for seam loops in combination with cabled yarns can enable the felt to achieve both acceptable fiber anchoring and easy installation.

Although these advantages are desirable, a potential shortcoming of the fabric 110 can occur when the fabric 110 and/or felt 100 are under tension, as when the felt 100 is installed on a papermaking machine. Tension can cause the ends 116*a* of the yarns 116 to "pull back" the CMD yarn 112 nearest the seam 102 (labelled as yarn 112' in FIG. 2) away from the seam 102. As a result, open areas may form between the ends 116*a* and the seam 102, which can produce an uneven, inconsistent seam.

Figure 3:
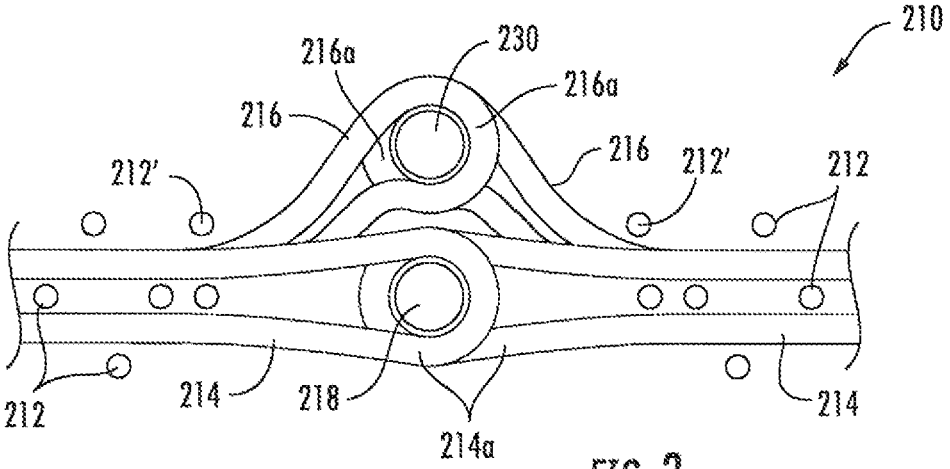
FIG. 3 is a side view of the seam area of a press felt base fabric according to embodiments of the invention showing how two pintles are employed during weaving.
Figure 4:
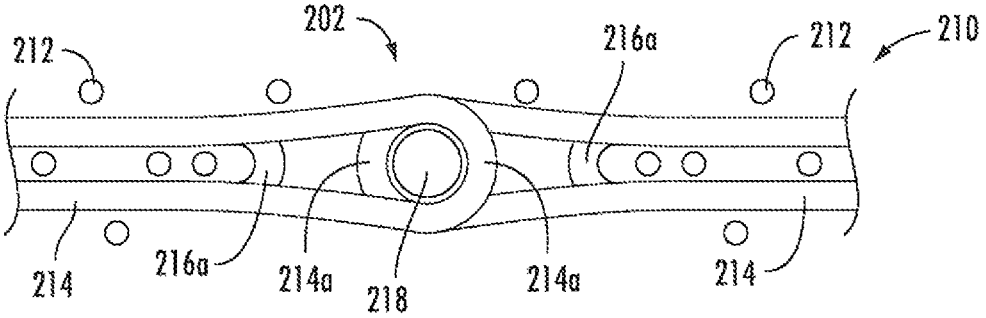
FIG. 4 is a side view of the seam area of FIG. 3 showing the base fabric after removal of the auxiliary pintle and after finishing.
Figure 5:
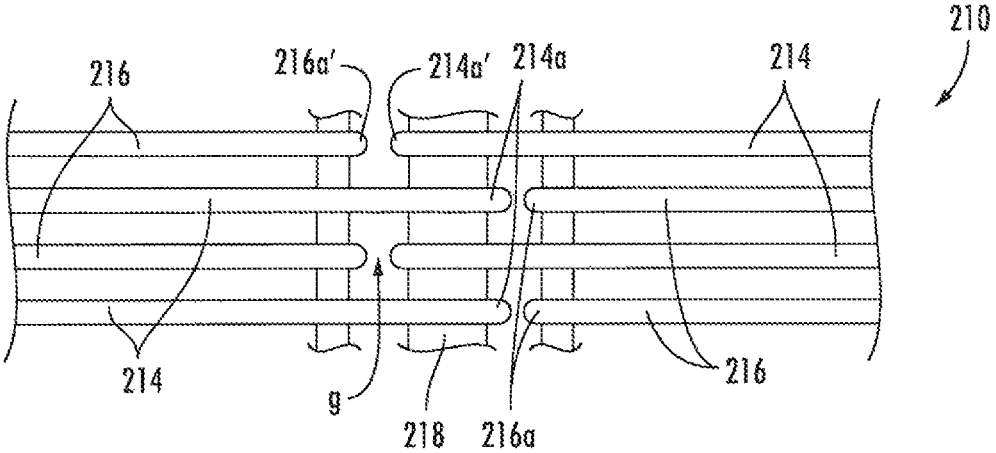
FIG. 5 is a top view of the seam area of FIG. 4.

This disadvantage can be addressed by a fabric 210 according to embodiments of the invention, shown in FIGS. 3-5. The fabric 210 has a similar weave pattern to the fabric 110 discussed above, with monofilament MD yarns 214 and cabled MD yarns 216 interwoven with CMD yarns 212. However, as shown in FIG. 3, the monofilament MD yarns 214 are woven such that their ends 214*a* form loops over a primary pintle 218, and the cabled MD yarns 216 are woven such that their ends 216*a* form loops over a secondary pintle 230 that is located above the primary pintle 218. Thus, the ends 216*a* of the cabled MD yarns 216 are positioned some distance from the CMD yarn 212 that is nearest the seam 202.

After weaving, the auxiliary pintle 230 is removed. Removal of the auxiliary pintle 230 results in the ends 216*a* of the cabled MD yarns 216 remaining positioned over the ends 214*a* of the monofilament MD yarns 214 as they are looped over the primary pintle 218.

The fabric 210 is then subjected to a heat-setting process. In some embodiments, the heat-setting process involves subjecting the fabric 210 to some degree of tension; this tension tends to draw the ends 216*a* of the cabled MD yarns 216 slightly away from the seam 202, to a position in which the ends 216*a* are adjacent, and in some instances in contact with and may slightly overlie, the ends 214*a* of the monofilament MD yarns 214 that approach the seam 202 from the opposite side of the seam 202. For example, in FIG. 5, it can be seen that the end 216*a*', which approaches the seam 202 from the left side of the figure, is adjacent the end 214*a*', which approaches the seam 202 from the right side of the figure. Consequently, the ends 216*a* of the cabled MD yarns 216 can partially or completely fill the gap g that can otherwise form between the ends of the cabled MD yarns and the seam as described above in connection with Patent Publication No. 2017/0037573, supra.

Typically, after heat-setting, the gap between an end 216*a* and an adjacent end 214*a* from the opposite direction is between about −0.3 mm to 0.3 mm (wherein a negative value for the gap g represents the end 216*a* slightly overlying its adjacent end 214*a*). In a typical fabric, the primary pintle 218 is removed and replaced with a smaller pintle or cable for use; in instances in which the ends 216*a* overlie their adjacent ends 214*a*, the use of a lower diameter pintle (e.g., replacing a 1.0-1.2 mm primary pintle 218 with a 0.35-0.40 mm pintle), any overlying ends 216*a* no longer overlie the ends 214*a*, but instead drop to a position that is in-plane with the ends 214*a*.

With respect to any of the illustrated or described embodiments, the press felt of the invention may also include one or more batt layers such as those described above in connection with the felt 100 and fabric 110.

Although the MD yarns 216 are illustrated and described as being cabled monofilament yarns, in some embodiments the MD yarns 216 may be cabled or twisted monofilament/multifilament and/or monofilament/card yarn combinations. Also, although the MD yarns 214 are illustrated and described as being monofilament yarns, in some embodiments the MD yarns 214 may be cabled or twisted monofilament/multifilament and/or monofilament/card yarn combinations. Further, the CMD yarns 212 are illustrated and described as being cabled monofilaments, but may in some embodiments be uncabled monofilaments. Other yarn varieties may also be employed.

Yarn sizes and configurations may vary with the desired properties of the press felt. Typical yarn diameters include monofilament MD yarns 214 of between about 0.2 mm and 0.6 mm. The cabled MD yarns 216 are typically formed of two or three yarns cabled together, with the typical diameter of the individual yarns (prior to cabling) being 0.10 mm to 0.40 mm. Similarly, the CMD yarns 212 are typically formed of two or three monofilament yarns cabled together, with the typical diameter of the individual monofilament yarns being 0.10 mm to 0.40 mm.

In one particular embodiment, the fabric 210 comprises the following yarns:

| Yarn Type | Yarn Employed |
|---|---|
| Monofilament MD yarns | 0.40 mm monofilament |
| Cabled MD yarns | 0.20 mm × 3 |
| Cabled CMD yarns | 0.20 mm × 3 |

Those skilled in this art will also appreciate that, although the monofilament MD yarns 214 and the cabled MD yarns 216 are shown in an alternating 1:1 pattern, these yarns may be included in other ratios. For example, there may be 1 monofilament MD yarn for every two or three cabled MD yarns, two or three monofilament MD yarns for every cabled MD yarn, three monofilament MD yarns for every two cabled MD yarns, two monofilament MD yarns for every three cabled MD yarns, and the like.

It should also be noted that in some embodiments, the fabric 210 is endless woven.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A fabric for a press felt, comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle;

wherein the MD yarns of the first set alternate with the MD yarns of the second set.

2. The fabric defined in claim 1, wherein the first set of MD yarns comprises monofilament yarns.

3. The fabric defined in claim 2, wherein the second set of MD yarns comprises cabled yarns.

4. The fabric defined in claim 1, wherein the CMD yarns comprise cabled yarns.

5. The fabric defined in claim 1, wherein the first set of MD yarns differs in type from the second set of MD yarns.

6. A method of making a fabric for a press felt for a papermaking machine, comprising:

(a) forming a base fabric comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, comprising a plurality of repeat units, each of the repeat units comprising a plurality of cabled cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle; and (b) removing the second pintle from the ends of the second set of MD yarns; and (c) tensioning the fabric so that each of the ends of the second set of MD yarns forms a gap with a respective end of first set of MD yarns that approaches the seam from the opposite direction, and wherein the gap is no more than about 0.3 mm.

7. The method defined in claim 6, further comprising the step of attaching a batt layer overlying the fabric.

8. The method defined in claim 6, wherein the first set of MD yarn comprises monofilament yarns.

9. The method defined in claim 8, wherein the second set of MD yarns comprises cabled yarns.

10. The method defined in claim 8, wherein the CMD yarns comprise cabled yarns.

11. The method defined in claim 6, wherein the MD yarns of the first set alternate with the MD yarns of the second set.

12. The method defined in claim 6, wherein the first set of MD yarns differs in type from the second set of MD yarns.

13. The method defined in claim 6, wherein at least some of the ends of the second set of MD yarns contact a respective end of the first set of MD yarns that approaches the seam from the opposite direction.

14. The method defined in claim 6, wherein step (c) is performed during heat-setting of the fabric.

15. A method of making a fabric for a press felt for a papermaking machine, comprising:

(a) forming a base fabric comprising a plurality of repeat units, each of the repeat units comprising a plurality of cross machine direction (CMD) yarns and a plurality of machine direction (MD) yarns interwoven with the CMD yarns, wherein the machine direction yarns comprise a first set of MD yarns and a second set of MD yarns, comprising a plurality of repeat units, each of the repeat units comprising a plurality of cabled cross machine direction (CMD) yarns and a plurality of machine direction (MD) yarns interwoven with the CMD yarns, wherein the machine direction yarns comprise a first set of MD yarns and a second set of MD yarns, wherein the first set of MD yarns include seam loops at their ends that capture a first pintle, and wherein the second set of MD yarns include loops at their ends that capture a second pintle that is positioned above the first pintle; and (b) removing the second pintle from the ends of the second set of MID yarns; and (c) tensioning the fabric so that each of the ends of the second set of MD yarns slightly overlies a respective end of first set of MD yarns that approaches the seam from the opposite direction.

16. The method defined in claim 15, wherein step (c) is performed during heat-setting of the fabric.

17. The method defined in claim 15, further the steps of: (d) removing the first pintle; and (e) inserting a third pintle into the seam loops of the first set of MD yarns.

18. The method defined in claim 17, wherein any gaps between the end of each of the first set of MD yarns and the adjacent end of a respective one of the second set of MD yarns is less than about 0.3 mm.

* * * * *